US007772509B2

(12) United States Patent
Lee et al.

(10) Patent No.: US 7,772,509 B2
(45) Date of Patent: Aug. 10, 2010

(54) MULTI-DIRECTIONAL SWITCHING ASSEMBLY WHICH PREVENTS RATTLING OF DRIVE MEMBERS

(75) Inventors: Yongwoon Lee, Miyagi-ken (JP); Yoshiteru Takayanagi, Miyagi-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 893 days.

(21) Appl. No.: 11/613,048

(22) Filed: Dec. 19, 2006

(65) Prior Publication Data

US 2007/0144290 A1 Jun. 28, 2007

(30) Foreign Application Priority Data

Dec. 22, 2005 (JP) ..... 2005-370471

(51) Int. Cl.
*H01H 3/00* (2006.01)

(52) U.S. Cl. ..... 200/18

(58) Field of Classification Search ..... 200/177; 273/148 B

See application file for complete search history.

(56) References Cited

U.S. PATENT DOCUMENTS 6,580,039 B2 * 6/2003 Nakade et al. ..... 200/6 A
6,762,372 B2 * 7/2004 Nishimoto et al. ..... 200/4
6,836,403 B2 * 12/2004 Hsu ..... 361/679.09
6,841,751 B2 1/2005 Sasaki et al.
6,903,293 B2 6/2005 Sasaki
2005/0061639 A1 * 3/2005 Stringwell ..... 200/5 R
2005/0284737 A1 * 12/2005 Shitanaka et al. ..... 200/5 R

FOREIGN PATENT DOCUMENTS

JP 2000-322981 11/2000

* cited by examiner

*Primary Examiner*—Edwin A. Leon
*Assistant Examiner*—Vanessa Girardi
(74) *Attorney, Agent, or Firm*—Brinks Hofer Gilson & Lione

(57) ABSTRACT

Provided is an easily assembled multi-directional switching device that prevents the rattling of drive members, in which each pair of drive members mutually adjacent in the circumferential direction are connected to each other by an elastic arm member to form drive member units, and in which stem portions of the respective drive members are inserted in a casing from above corresponding guide holes to position the elastic arm members of the drive member units on the upper surface side of a top panel of the casing.

1 Claim, 3 Drawing Sheets

MULTI-DIRECTIONAL SWITCHING ASSEMBLY WHICH PREVENTS RATTLING OF DRIVE MEMBERS

This application claims the benefit of priority to Japanese patent application No. 2005-370471, filed on Dec. 22, 2005, which is incorporated herein by reference.

TECHNICAL FIELD

The present application relates to a multi-directional switching device and more particularly to a type of multi-directional switching device which converts the rotational movement of an operation knob into a linear movement

BACKGROUND

Conventionally, a multi-directional switching device has been known which includes a plurality of switching elements mounted on a printed-circuit board, a casing including the switching elements therein, a swiveling operation knob supported on a top panel of the casing, and a plurality of drive members interposed between the operation knob and the respective switching elements, and which converts the rotational movement of the operation knob oscillated and operated by a user into the linear movement through one of the drive members and transmits the linear movement to the corresponding one of the switching elements (refer to Japanese Unexamined Patent Application Publication No. 2000322981, for example). The above switching elements are formed by a so-called rubber switch, for example, which includes a plurality of fixed contacts provided on the upper surface of the printed-circuit board and movable contacts provided on the inner bottom surfaces of a plurality of projections integrally formed with an elastic member, such as rubber. The drive members are provided to a plurality of cylindrical members hanging from the top panel of the casing, and are inserted in respective guide holes to be capable of ascending and descending. Since the lower end of each of the drive members is formed with a flange portion larger in diameter than the corresponding guide hole, the drive member is prevented from escaping upward from the guide hole. Further, the lower ends of the respective drive members are in contact with the upper surfaces of the corresponding projections of the switching elements. With the flange portions of the drive members connected with one another by elastic arm members, the plurality of the drive members can be handled as one integrated part.

When the multi-directional switching device configured as summarized above is in a non-operational state in which the operation knob is not oscillated and operated, the respective drive members are projected from the upper ends of the corresponding guide holes under the biasing force applied by the projections of the switching elements, and the operation knob is kept at the neutral position under the equal force applied by the respective drive members. In this state, if the user oscillates and operates the operation knob in an arbitrary direction, the drive member located in the direction is selectively pressed by the operation knob and descends in the corresponding guide hole. Thereby, the projection located below the drive member is buckled and deformed to place the corresponding switching element into the ON operation. In this process, the upper end of the drive member located 180 degrees opposite the oscillation direction is separated from the operation knob. However, the flange portion of the drive member receives the biasing force applied by the corresponding projection and comes into contact with the lower end of the corresponding cylindrical member. Thus, the drive member is prevented from rattling due to external vibration. When the above control force on the operation knob is removed, the pressed drive member is raised by the restoring force of the buckled and deformed projection. Accordingly, the switching element switches from the ON state to the OFF state, and the operation knob returns to the original neutral position.

In the conventional multi-directional switching device configured as described above, the respective drive members formed with the flange portions at the lower ends thereof are biased toward the upper parts of the guide holes by the elastic force of the switching elements. Therefore, even if the upper end of an arbitrary one of the drive members is separated from the operation knob in the oscillating operation of the operation knob, the movement of the drive member in the upward and downward directions is controlled, with the flange portion of the drive member in contact with the lower end of the corresponding cylindrical portion. Thus, the drive member is prevented from rattling due to the external vibration or the like and from generating abnormal noise. In the assembly process of the multi-directional switching device, however, the operation knob is attached to the top panel of the casing, and thereafter the casing is turned upside down to insert the drive members to the guide holes of the respective cylindrical members. This inevitably makes the direction of attaching the operation knob to the casing opposite to the direction of attaching the drive members to the casing, which has been a major factor preventing the automation of the assembly process. Meanwhile, the flange portions formed at the lower ends of the respective drive members are connected to one another by the elastic arm members, and thus the plurality of the drive members can be inserted in the corresponding guide holes at the same time. Although the multi-directional switching device has such an advantage, when an arbitrary one of the drive members descends through the oscillating operation of the operation knob, the descending of the drive member affects the elastic arm members and makes the other drive members tend to descend together with the drive member. This may trigger such phenomena as the malfunction of the switching elements and the deterioration of the operation feeling in operating the switching device.

SUMMARY

In an aspect, multi-directional switching device includes a plurality of switching elements mounted on a printed-circuit board, a casing including the switching elements therein, a swiveling operation knob supported on a top panel of the casing, and a plurality of drive members interposed between the operation knob and the switching elements. In the multi-directional switching device, the drive members are inserted in a plurality of guide holes formed on the top panel of the casing to be capable of ascending and descending, and the respective guide holes are arranged around the oscillation supporting point of the operation knob. Further, the multi-directional switching device is configured such that an arbitrary one of the drive members is connected via an elastic arm member to another one of the drive members located adjacent to at least one side of the arbitrary drive member in the circumferential direction, and that the drive members are inserted in the casing from above the guide holes to thereby position the elastic arm member on the upper surface side of the top panel of the casing.

In the thus configured multi-directional switching device, the attaching of the operation knob to the casing and the insertion of the respective drive members in the guide holes may both be carried out from the upper surface side of the top panel of the casing. Accordingly, the multidirectional switching device may be amenable to automation of the assembly process thereof. When the operation knob is tilted in an arbitrary direction through the oscillating operation, each of the drive members located in other directions than the tilt direction may move in the upward and downward directions due to a gap formed between the drive member and the operation knob. However, since adjacent ones of the drive members are connected via the elastic arm member, the drive member moves by the travel distance of the drive member which moves by the shortest travel distance among the drive members, or the drive member does not move if anyone of the drive members connected to the driver member is in contact with the operation knob. Accordingly, the drive members may be prevented from rattling due to external vibration during the oscillating operation of the operation knob.

In the above configuration, there is no limitation on the number of the plurality of the drive members. For example, eight-directional switching device can be formed by using eight drive members. Further, the entire plurality of the drive members may be integrated by sequentially connecting the drive members to one another in the circumferential direction via the elastic arm members. The number of the drive members may be four, so that the two mutually adjacent drive members are integrated with the opposite ends of the elastic arm member to form one drive member unit, and that the four drive members are divided into two such drive member units. In a case in which the above configuration is employed and one of the drive members is provided at a position 180 degrees opposite to the direction of oscillating operation of the operation knob, when an arbitrary one of the drive members is pressed through the oscillating operation of the operation knob and descends in the corresponding guide hole, the drive member located at the position 180 degrees opposite to the oscillation direction separates from the operation knob. The drive member, however, is included in the different drive member unit from the drive member unit including the drive member descending in the guide hole, and thus is stably held, unaffected by the descending drive member. At the same time, the driver member does not adversely affect the descending drive member, and thus the malfunction of the switching elements and the deterioration of the operation feeling may be prevented.

Further, in the above configuration, the top panel of the casing may be provided with cylindrical members standing thereon and drilled with guide holes, and the upper end surfaces of the drive members may be provided with skirt portions hanging therefrom and overlapping with the outer wall surfaces of the cylindrical members. In this configuration the penetration of a foreign substance, such as dust, through the guide holes into the switching elements included in the casing may be prevented.

In a multi-directional switching device, a swiveling operation knob is supported on a top panel of a casing including a plurality of switching elements therein, and the rotary movement of the operation knob is converted into the linear movement, through one of a plurality of drive members inserted in guide holes formed on the top panel of the casing to be capable of ascending and descending, and is transmitted to the corresponding one of the switching elements. In the multi-directional switching device, an arbitrary one of the plurality of drive members is connected via an elastic arm member to another one of the plurality of drive members adjacent to at least one side of the arbitrary drive member in the circumferential direction, and the respective drive members are inserted in the casing from above the guide holes to thereby position the elastic arm member on the upper surface side of the top panel of the casing. Thus, the attaching of the operation knob to the casing and the insertion of the respective drive members in the guide holes may both be carried out from the upper surface side of the top panel of the casing. Accordingly, the multi-directional switching device is compatible with automation of the assembly process thereof, and also may suppress the rattling of the drive members due to the external vibration in the oscillating operation of the operation knob.

DETAILED DESCRIPTION

Figure 1:
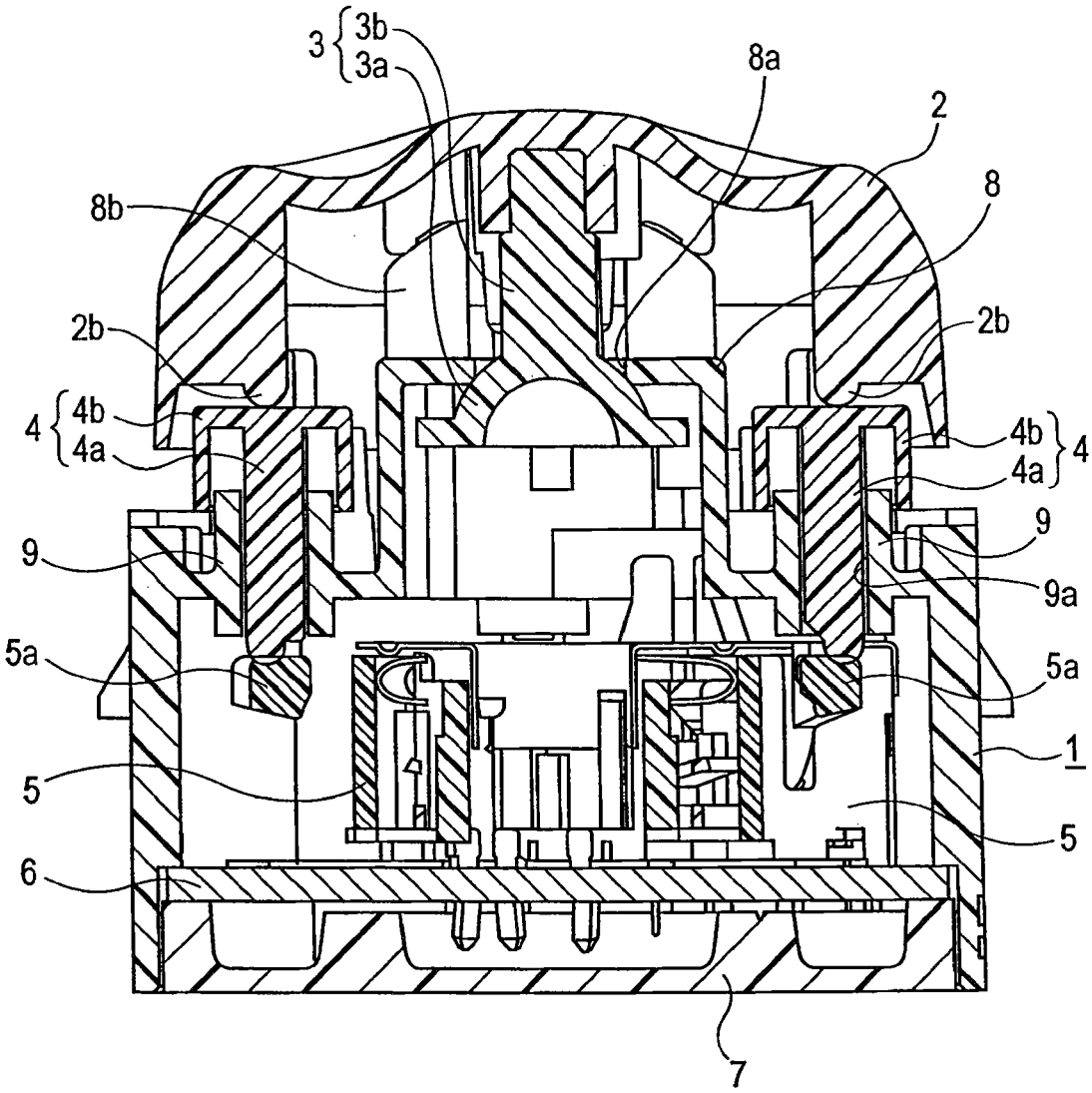
FIG. 1 is a cross-sectional view of a multi-directional switching device according to an embodiment.
Figure 2:
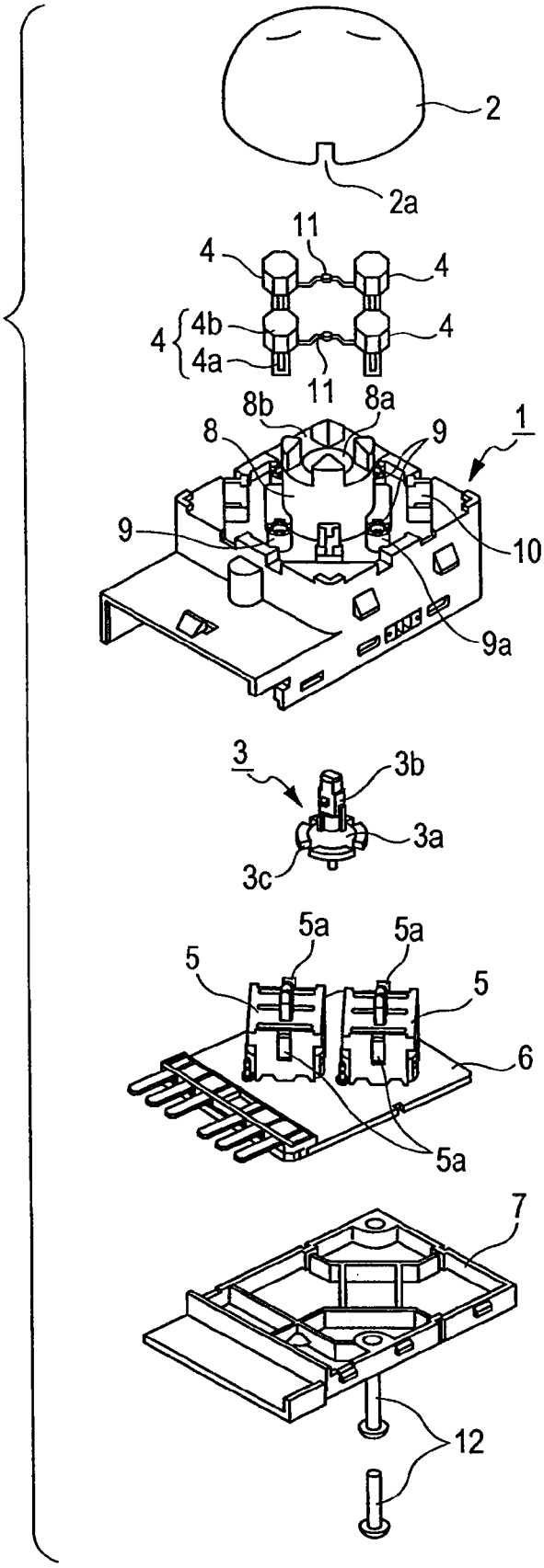
FIG. 2 is an exploded perspective view of the multi-directional switching device.

Exemplary embodiments may be better understood with reference to the drawings, but these embodiments are not intended to be of a limiting nature. Like numbered elements in the same or different drawings perform equivalent functions.

A multi-directional switching device includes a casing 1 of a hollow structure having an open lower surface, an operation knob 2 of a circular bowl shape oscillated and operable by a user, a holder 3 oscillatably supporting the operation knob 2 on the top panel of the casing 1, four drive members 4 for converting the rotary movement caused by the oscillating operation of the operation knob 2 into the linear movement, switch units 5 operated by the respective drive members 4, a printed-circuit board 6 mounted with the switch units 5, and a bottom cover 7 for covering the lower surface of the casing 1. The casing 1, the operation knob 2, the holder 3, the drive members 4, and the bottom cover 7 may be molded from a synthetic resin material.

Figure 3:
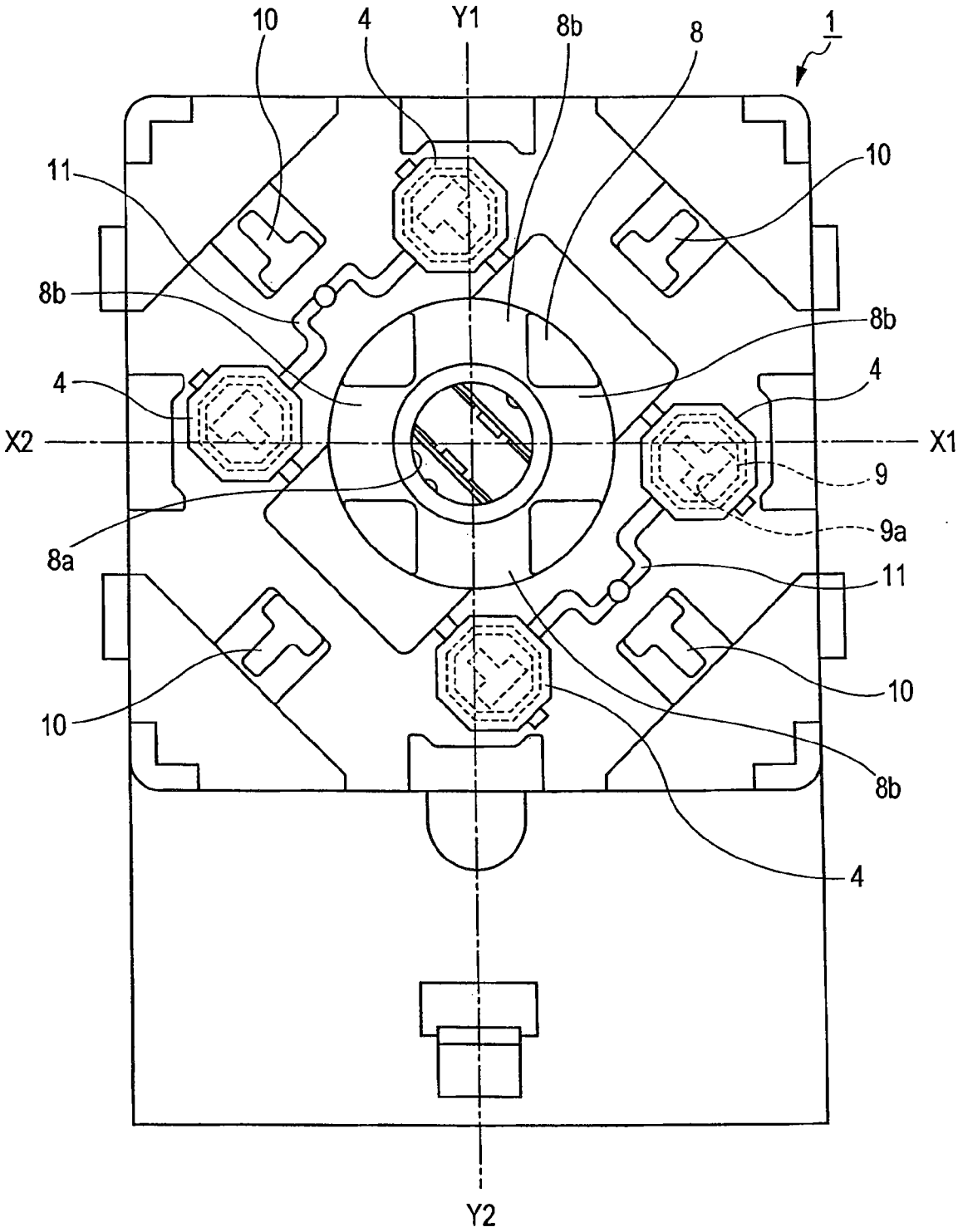
FIG. 3 is a plan view of the multi-directional switching device, in which an operation knob is omitted.

The top panel of the casing 1 is provided with a cylindrical base 8 standing thereon, and four cylindrical members 9 and four regulating projections 10 stand around the base 8. A through hole 8*a* in the base 8 is formed with four concave grooves 8*b* which are provided around the through hole 8*a* at equal intervals of 90 degrees. Each of the cylindrical members 9 is located on a line extended from the corresponding one of the concave grooves 8*b*, and is formed with a guide hole 9*a*. Further, each of the regulating projections 10 is formed into a T-shape, as viewed in the plan view, and is located at a position intermediate and outside of a straight line connecting two of the cylindrical members 9 adjacent to the regulating projection 10. As illustrated in FIG. 3, when X and Y orthogonal coordinate axes are positioned with the center of the through hole 8*a* serving as the origin of the coordinate axes, the cylindrical members 9 are formed on axes X1, Y1, X2, and Y2 located in the extending directions of the respective concave grooves 8*b*, and the regulating projections 10 are formed on coordinate axes rotated by 45 degrees with respect to the X and Y orthogonal coordinate axes.

The lower end of the through hole 8*a* of the casing 1 may be in contact with a hemispheric portion 3*a* of the holder 3, and the holder 3 is formed with a connecting rod 3*b* extending from the hemispheric portion 3*a* and inserted through the through hole Sa to project outside the casing 1. The central portion of the inner bottom surface of the operation knob 2 is snap-connected to, and integrated with, the upper end of the connecting rod 3*b*. Thus, the swiveling operation knob 2 may be supported on the top panel of the casing 1. A plurality of slits 3*c* formed around the hemispheric portion 3*a* may be engaged with regulating projections (not illustrated) formed inside the casing 1, and thus the movement of the holder 3 may be regulated in the rotation direction with respect to the casing 1. Thus, the operation knob 2 is oscillatable in the extending directions of the respective concave grooves 8*b* (i.e., the directions of X1, Y1, X2 and Y2 shown in FIG. 3). The lower end of the outer circumferential wall of the operation knob 2 is formed with four slits 2*a* at equal intervals of 90 degrees, and the respective slits 2*a* face the four regulating projections 10 standing on the top panel of the casing 1. The inner circumferential wall of the operation knob 2 is integrated with four driving projections 2*b* located directly above the four cylindrical members 9 standing on the top panel of the casing 1. That is, the four slits 2*a* and the four driving projections 2*b* are alternately formed on the operation knob 2 at equal intervals of 45 degrees in the circumferential direction.

Each of the drive members 4 includes a stem portion 4*a* inserted in the guide hole 9*a* of the corresponding cylindrical member 9, and the upper end of the stem portion 4*a* is integrated with a cylindrical skirt portion 4*b* moving up and down around the outer side of the cylindrical member 9. Among the four drive members 4 corresponding to the respective guide holes 9*a*, each two drive members 4 mutually adjacent in the circumferential direction are connected to each other at the skirt portions 4*a* 4*b* thereof by an elastic arm member 11. The elastic arm member 11 and the two drive members 4 form one drive member unit. That is, the four drive members 4 are divided into two drive member units of the same shape. Each of the drive member units includes the drive members 4 at the opposite ends of the elastic arm member 11. The upper end surfaces of the stern portions 4*a* are in contact with the driving projections 2*b* of the operation knob 2. As illustrated in FIG. 1, when the operation knob 2 is maintained in a neutral position in the non-operational state, and the skirt portions 4*b* of the respective drive members 4 may be overlapped with the upper end portions of the cylindrical portions 9.

Each of the switch units 5 includes two actuators 5*a* projecting from mutually facing side surfaces of a chassis of the switch unit 5. The chassis contains two switching elements driven by the rotary movement of the respective actuators 5*a*. The printed-circuit board 6 is mounted with two switch units 5 of the above configuration. The four actuators 5*a* projecting from the chassis of the two switch units 5 are in contact with the lower ends of the stem portions 4*a* of the respective drive members 4. Further, the bottom cover 7 is fixed to the casing 1 by using in combination the snap connection and a screw 12, and the lower surface of the printed-circuit board 6 stored in the casing 1 is covered by the bottom cover 7. The present embodiment uses two two-piece type switch units 5, each including two switching elements. Alternatively, four separate switching elements referred to as tact switches, for example, may be used. In another aspect, a four-piece type switch unit referred to as a rubber switch, for example, in which four projections including movable contacts are integrated with an elastic member, may be used.

As illustrated in FIG. 1, when the multi-directional switching device is in a non-operational state in which the operation knob 2 is not oscillated and operated, the upper end surfaces of the respective drive members 4 are in contact with the driving projections 2*b* of the operation knob 2. The drive members 4 are sized such that the actuators 5*a* of the switch units 5 apply some amount of biasing force not causing the switch to operate, and the operation knob 2 is held at the neutral position with the equal force applied by the four drive members 4. In this state, if the user oscillates and operates the operation knob 2 in an arbitrary direction, e.g., in the direction of X1 shown in FIG. 3, the operation knob 2 is rotated in the direction of X1, with the Y axis serving as the rotational axis. Thus, one of the drive members 4 located in the direction of X1 is selectively pressed by the corresponding driving projection 2*b*. As a result, the drive member 4 descends in the corresponding guide hole 9*a*, and causes the corresponding actuator 5*a* to rotate. Thus, one of the switching elements of the switch units 5 is selectively placed into the ON operation, and the operation direction of the operation knob 2 may be detected on the basis of an ON signal emitted by the ON operation. As for the remaining three drive members 4 located in the directions of Y1, X2, and Y2, the two drive members 4 located in the direction of the Y axis are held at an approximately same position as in the non-operational state and thus do not move in the upward and downward directions, since the rotational axis of the operation knob 2 is located on a straight line connecting the leading ends of the two driving projections 2*b* corresponding to the two drive members 4, and since the elasticity of the elastic arm members 11 is adjusted so as not to exceed the actuating force for actuating the switch units 5. As for the remaining drive member 4 located in the direction of X2, 180 degrees opposite to the oscillation direction of the operation knob 2 (i.e., the direction of X1), when the driving projection 2*b* corresponding to the drive member 4 rotates and moves upward, the drive member 4 ascends by a distance moved by the biasing force applied to the switch units 5 at the neutral position, and a gap is formed between the drive member 4 and the driving projection 2*b*. Thus, if the drive member 4 receives vibration, the drive member 4 may rattle in the upward and downward directions. However, the drive member 4 is connected, via the elastic arm member 11, to the drive member 4 located in the direction of Y1, and not moving up and down. Thus, the elastic arm member 11 may prevent the drive member 4 from moving (i.e., rattling) in the upward and downward directions. Further, since the drive member 4 located in the direction of X2 is included in the different drive member unit from the drive member unit including the drive member 4 located in the direction of X1, the drive member 4 located in the direction of X2 may not be affected nor affect the oscillating operation of the drive member 4 located in the direction of X1. Therefore, even if the rigidity of the elastic arm members 11 is increased to stably hold the drive members 4, and if each of the elastic arm members 11 is integrally connected to a pair of the drive members 4, the influence thereof on deterioration of the operation feeling in operating the operation knob 2 can be reduced.

If the control force on the operation knob 2 is removed, the actuator 5*a* rotates and returns to the previous position due to the repulsive force of a return spring (not illustrated) included in the switch unit 5. Thus, the pressed drive member 4 ascends to the original position in the guide hole 9*a*. Accordingly, the switching element of the switch unit 5 switches from the ON state to the OFF state, and the operation knob 2 automatically returns to the neutral position shown in FIG. 1. This is the same in a case in which the operation knob 2 is oscillated and operated in a different direction from the direction of the above example. For example, if the operation knob 2 is oscillated and operated in the direction of Y1 shown in FIG. 3, the operation knob 2 rotates in the direction of Y1, with the X axis serving as the rotational axis. Thus, the drive member 4 located in the direction of Y1 descends in the corresponding guide hole 9*a*, and causes the corresponding actuator 5*a* of the corresponding switch unit 5 to rotate. In this case, the drive member 4 located in the direction of Y2 180 degrees opposite to the oscillation direction of the operation knob 2 (i.e., the direction of Y1) separates from the corresponding driving projection 2*b*. However, the drive member 4 is included in the different drive member unit from the drive member unit including the drive member 4 located in the direction of Y1, and is connected, via the elastic arm member 11, to the drive member 4 located in the direction of X1 and not moving up and down. Accordingly, the elastic arm member 11 may prevent the drive member 4 from moving (i.e., rattling) in the upward and downward directions.

The casing 1 including therein the switch units 5 may be provided with the four cylindrical members 9 standing on the top panel of the casing 1 at the equal intervals of 90 degrees in the circumferential direction. The four drive members 4 are inserted in the guide holes 9*a* of the cylindrical members 9 so as to be capable to ascending and descending. Each two of the four drive members 4 mutually adjacent in the circumferential direction are connected to each other by the elastic arm member 11, and the stem portions 4*a* of the respective drive members 4 are inserted in the casing 1 from above the corresponding guide holes 9*a*. Thus, the elastic arm member 11 is positioned on the upper surface side of the top panel of the casing 1. The respective parts may be all attached from a single direction with respect to the casing 1, and the multi-directional switching device is compatible with automation of the assembly process thereof. That is, in an assembly line, the holder 3 placed on a jig (not illustrated) may covered by the casing 1 such that the connecting rod 3*b* projects from the through hole 8*a*. In this state, the stem portions 4*a* of the respective drive members 4 may be inserted in the corresponding guide holes 9*a* from above the casing 1, and thereafter the central portion of the inner bottom surface of the operation knob 2 is snap-connected to the upper end of the connecting rod 3*b* projecting from the through hole 8*a*. Thus, the respective drive members 4 and the operation knob 2 can be attached onto the top panel of the casing 1. The casing 1 in the above state may be conveyed to the next stage by a conveyor or the like, and then is covered from above the printed-circuit board 6 mounted with the switch units 5 and the bottom cover 7. The bottom cover 7 may be snapped in the casing 1, and the two parts are integrated with each other.

Further, in the multi-directional switching device, two mutually adjacent ones of the drive members 4 are connected to each other by the elastic arm member 11 to form one drive member unit, and two such drive member units are used to divide the four drive members into the two drive member units of the same shape. Thus, when an arbitrary one of the drive members 4 is selectively pressed and driven through the oscillating operation of the operation knob 2, the rattling of the drive member 4 located at the position 180 degrees opposite to the oscillation direction may be suppressed by the elastic arm member 11 included in the different drive member unit from the drive member unit including the pressed and driven drive member 4. Therefore, even if the rigidity of the elastic arm members 11 is increased to stably hold the drive members 4, it is possible to minimize the effect of the rigidity of the elastic arm members 11 in preventing the pressing operation of pressing the drive member which needs to be driven. Accordingly, the malfunction of the switch units 5 and the deterioration of the operation feeling in operating the operation knob 2 can be prevented. Further, the upper ends of the stem portions 4*a* of the respective drive members 4 are formed with the skirt portions 4*b*, and the skirt portions 4*b* and the cylindrical members 9 are overlapped with each other such that the inner surface of each of the skirt portions 4*b* moves up and down around the outside of the corresponding cylindrical member 9. Accordingly, a foreign substance, such as dust, can be prevented from penetrating into the casing 1 through the guide holes 9*a*, and a simple dust-preventing structure can be provided.

In another aspect, eight drive members may be provided at intervals of 45 degrees around the oscillation supporting point of the operation knob, with each two or four of the drive members connected by the elastic arm member.

Further, the actuators of the switch units may be provided on the lines of the oscillation directions of the operation knob. Alternatively, for example, the operation knob may be made capable of oscillating in directions intermediate between the respective actuators of the switch units (i.e., the directions intersecting with the X and Y coordinate axes shown in FIG. 3 at 45 degrees). Further, when the operation knob is oscillated and operated in one of the above directions, two actuators facing each other across a straight line extending along the oscillation direction may be driven to place the two switching elements of the corresponding switch unit into the ON operation and to determine the operation direction of the operation knob on the basis of ON signals emitted by the ON operation.

Although only a few exemplary embodiments of this invention have been described in detail above, those skilled in the art will readily appreciate that many modifications are possible in the exemplary embodiments without materially departing from the novel teachings and advantages of the invention. Accordingly, all such modifications are intended to be included within the scope of this invention as defined in the following claims.

What is claimed is:

1. A multi-directional switching device comprising:

a plurality of switch units mounted on a printed circuit board;

a casing including the switch units therein;

a swiveling operation knob supported on a top panel of the casing;

four drive members interposed between the operation knob and the switch units;

the drive members being slidably inserted into a plurality of guide holes formed on the top panel of the casing, and the respective guide holes being arranged around the oscillation supporting point of the operation knob;

an arbitrary one of the drive members being connected via an elastic arm member to another one of the drive members located adjacent to at least one side of the arbitrary drive member in the circumferential direction, and the drive members being inserted in the casing from above the guide holes so as to position the elastic arm member on an upper surface side of the top panel of the casing;

two mutually adjacent drive members being connected with the opposite ends of the elastic arm member to form one drive member unit, and the four drive members being divided into two drive member units;

cylindrical members projecting from the top panel of the casing and being formed with the guide holes; and skirt portions descending from an upper end surface of the drive members and overlapping outer walls of the cylindrical members.

* * * * *